United States Patent [19]

Muser

[11] Patent Number: 4,735,579

[45] Date of Patent: Apr. 5, 1988

[54] ADAPTOR FOR CENTRAL VACUUM SYSTEM INLET VALVE ASSEMBLY

[76] Inventor: Oscar P. Muser, 1054 South Service Road East, Oakville, Ontario, Canada, L6J 2X7

[21] Appl. No.: 48,319

[22] Filed: May 11, 1987

[30] Foreign Application Priority Data

May 23, 1986 [CA] Canada ..... 509831

[51] Int. Cl.[4] ..... H01R 13/46

[52] U.S. Cl. ..... 439/191; 439/535; 439/536

[58] Field of Search ..... 174/47; 200/61.6; 285/7; 15/314; 439/190–192, 194–195, 198, 535–536, 142, 144

[56] References Cited

U.S. PATENT DOCUMENTS 3,483,503 12/1969 Paradiso ..... 439/192

4,336,427 6/1982 Lindsay ..... 439/191

FOREIGN PATENT DOCUMENTS 1163710 9/1969 United Kingdom ..... 200/61.6

*Primary Examiner*—John McQuade

*Attorney, Agent, or Firm*—Dressler, Goldsmith, Shore, Sutker & Milnamow, Ltd.

[57] ABSTRACT

An inlet valve assembly for a central vacuum cleaner system is provided with a mounting bracket plate having a circular inlet aperture therethrough and at least one electrical service aperture, and an adaptor for snap engagement with the mounting bracket plate through said inlet aperture. The adaptor comprises a deformable open-ended cylindrical connector of outside diameter slightly greater than the diameter of the inlet aperture, a flange projecting laterally from one end of the connector and adapted to overlie at least a part of the mounting bracket plate including the electrical service aperture, and an outer peripheral groove about the cylindrical connector and adjacent said flange. The deformable cylindrical connector is adapted for insertion into the inlet aperture until the flange abuts the connector plate, whereupon the edge of the inlet aperture snaps into the groove in the outer surface of the cylindrical connector to securely attach the adaptor to the mounting bracket plate.

13 Claims, 3 Drawing Sheets

ADAPTOR FOR CENTRAL VACUUM SYSTEM INLET VALVE ASSEMBLY

BACKGROUND OF THE INVENTION

This application relates to central vacuum cleaning systems, and particularly an adaptor for use in an inlet valve assembly employed in such systems.

Conventional inlet valve assemblies consist of an inlet valve having a cover plate disposed primarily on the outer surface of a wall, and a mounting bracket assembly, usually of metal, and disposed on the inner surface of a wall, such as a conventional stud and drywall structure commonly used in residential buildings. The inlet valve includes a decorative cover or face plate which lies against the outer surface of the wall, similar to the cover plate which overlies a conventional light switch or duplex outlet. However, in the case of the central vacuum inlet valve face plate, the plate has a circular aperture therethrough and a cylindrical extension extending from the back of the aperture through the wall and adapted to communicate with tubular ducting which leads to the central vacuum power unit. The face plate is provided with a spring biased flap which lies flush with the surface of the face plate to cover the circular opening when the inlet valve is not in use, but which may be drawn away from the surface of the face plate against the bias of the spring to permit insertion of one end of a hose and nozzle assembly. The inlet valve includes, within the cylindrical extension, two electrical contacts which coact with the inserted end of the hose and nozzle assembly to automatically initiate operation of the central vacuum power unit upon insertion.

The mounting bracket assembly is essentially a flat metal plate which is disposed behind the wall and is normally secured to a wall stud or the like. The bracket plate is provided with a relatively large inlet aperture which receives the cylindrical extension on the rear of the face plate, and additional apertures to receive fasteners required to secure the bracket plate to a wall stud or the like, to secure the inlet valve face plate to the mounting bracket plate, and to permit the passage of electrical wires therethrough for connection into the back of the face plate and to the aforementioned electrical contacts therein. The mounting bracket assembly is further provided with a deformable gasket about the inlet aperture to snugly and sealingly receive the cylindrical member of the face plate, the gasket being interposed between the mounting bracket plate and the end flange of a cylindrical connecting member adapted to be connected into the tubular ducting. The flange of the cylindrical member, the sealing gasket, and the mounting bracket plate are secured together by means of rivets or like securement means, and together form the inlet valve mounting bracket assembly.

When a central vacuum system is being installed in a new residence, the inlet valve mounting bracket assembly is installed in a desired location, for example, by securing the mounting bracket assembly to one of the studs before the drywall is applied, and the tubular ducting is installed between the mounting bracket assembly and the central vacuum power unit, with the cylindrical connector of the mounting bracket assembly being glued or otherwise secured into an end of the tubular ducting. Electrical wires are then passed through one of the electrical apertures in the mounting bracket plate, and the drywall is applied to the studs with an opening being provided adjacent the mounting bracket assembly inlet aperture. As a final step in completing the wall and the central vacuum system, the inlet valve is applied to the outer surface of the wall, with the electrical wires first being connected to the contact connectors on the back of the face plate, and the cylindrical extension on the back of the face plate being inserted through the inlet aperture of the mounting bracket assembly, and snugly retained therein by means of the circular gasket to provide a sealed communication between the cylindrical extension and the ducting leading to the central vacuum power unit. The face plate is then secured to the mounting bracket assembly by insertion of screws or like fastening devices through apertures in the face plate and into the fastening apertures on the mounting bracket in a manner similar to the cover of a conventional light switch or duplex outlet.

The inlet valve is relatively easy to install in a system such as that just described. However, the mounting bracket assembly is relatively expensive to produce, in that it comprises a number of parts, i.e., the relatively flat mounting plate, the circular gasket about the inlet aperture, the flanged cylindrical connector, and the connecting means (usually four rivets or screws are employed) for connecting the flange, gasket and the mounting plate together. Further, the apertures through which the electrical wires pass are normally punched out of the flat plate, with the result that their edges are relatively sharp and can readily damage the insulating covering on the wires. Any attempt to remove the sharp edges would result in considerable additional processing or hand labour, and would increase the complexity and cost of production of the mounting bracket assembly.

SUMMARY OF THE INVENTION

I have found that production of the assembly may be greatly simplified, and the problems of wiring damage due to the sharp edges on the electrical service apertures eliminated, by utilizing a single adaptor which may be snapped into the mounting bracket plate on location, thus eliminating the relatively costly preassembly of the mounting bracket assembly, and reducing the number of components required to produce a satisfactory assembly from seven (plate, gasket, flanged cylindrical adaptor and four connecting rivets) to two (plate and adaptor).

The mounting bracket adaptor in accordance with the invention is formed of electrically insulating plastic material, and comprises a deformable open-ended cylindrical connector of slightly larger outside diameter than inlet the aperture of the mounting bracket plate, and a relatively flat flange projecting laterally about one end thereof. The cylindrical member is provided with an outer peripheral groove adjacent the flange member whereby to receive the edge of the mounting plate inlet aperture for snap attachment of the adaptor to the plate with the cylindrical connector extending through the inlet aperture and projecting to the rear of the plate, and the flange abutting and overlying at least a part of the front surface of the plate.

The flange portion of the adaptor may be provided with apertures therethrough having a beaded circumferential lip on the rear surface thereof (the same side as the cylindrical projection) adapted for snap engagement with at least one electrical service aperture through the metal mounting plate to isolate electrical wiring passing therethrough from the sharp edges of the plate apertures, and to provide a fully insulated opening for the passage of electrical wires therethrough. This additional securement also prevents twisting of the adaptor relative to the mounting plate during installation.

BRIEF DESCRIPTION OF THE DRAWINGS

In drawings which illustrate an embodiment of the invention.

DESCRIPTION OF THE PREFERRED EMBODIMENT

Figure 6:
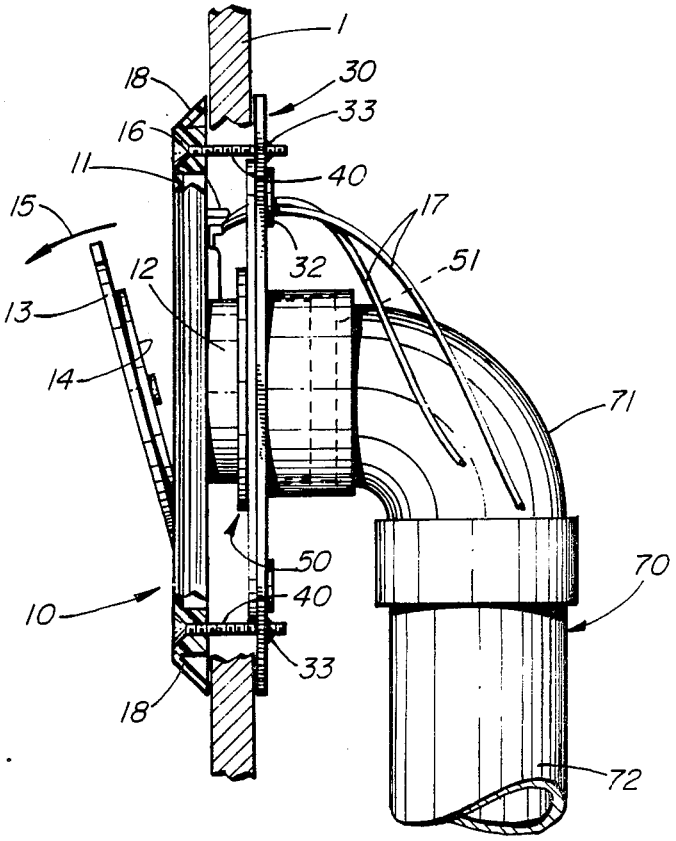
FIG. 6 is a side view of an assembled inlet valve, mounting bracket assembly, and tubular ducting section.

Referring now to the drawings, FIG. 6 provides a side view, partially in section, of a central vacuum inlet valve assembly installed in a wall 1. The assembly consists of an inlet valve depicted generally at 10, a mounting bracket plate 30, an adaptor 50 and tubular ducting 70.

The inlet valve 10 is conventional in construction, and consists of a decorative cover or face plate 11 an open-ended cylindrical or tubular projection 12 projecting rearwardly of the decorative cover, and providing communication between the interior of a room and the ducting 70, and a cover flap 13 having a circular sealing gasket 14 secured to the inner surface thereof to close the room side end of the tubular projection 12 when the cover flap is in closed position essentially flush with the decorative cover. The cover flap 13 is normally spring biased to its closed position in a recessed portion of the decorative cover 11. However, the flap may be drawn away from the decorative cover in the direction of the arrow 15 to open the room end of the cylindrical projection 12 for insertion of an end of a vacuum hose and nozzle assembly (not shown). The inlet valve is also provided with connectors 16 for connection of electrical wiring thereto, which connectors are connected to electrical contacts (not shown) on the inner surface of the cylindrical projection 12 whereby insertion of an end of a vacuum hose and nozzle assembly automatically completes a circuit through the contacts to activate the central vacuum power unit and induce suction in the hose and nozzle assembly. The decorative cover 11 is provided with a pair of fastener apertures 18 therethrough for reasons which will later be apparent. The foregoing is conventional, and does not, per se, form an element of the invention.

Figure 3:
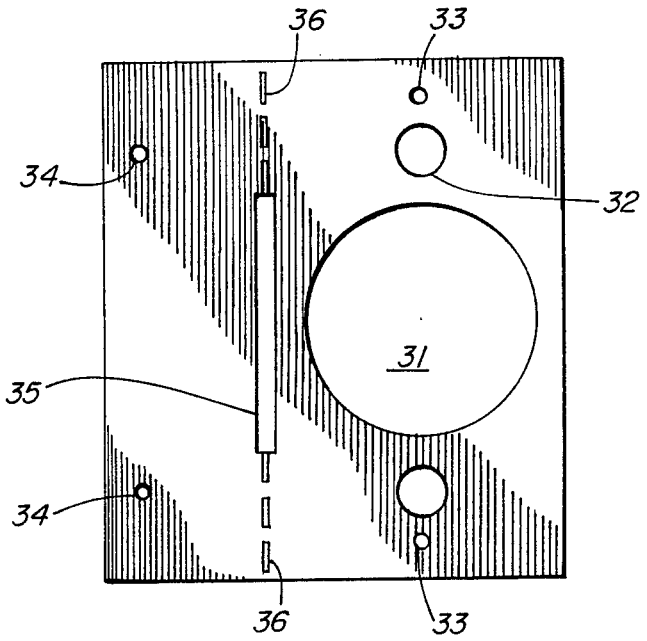
FIG. 3 is a front view of a mounting bracket plate.

The mounting bracket plate 30, as best shown in FIG. 3, is provided with an inlet aperture 31 through which the cylindrical projection 12 of the inlet valve may pass, electrical service apertures 32, for the passage of electrical wiring such as wires 17 (FIG. 6), therethrough, fastener apertures 33, to receive a fastener such as a screw 40 or the like, to connect the cover plate, through apertures 18, to the mounting bracket plate, and mounting apertures 34 whereby the mounting bracket plate may be readily secured to a wall stud or the like by nails, screws, or other suitable means, not shown. As it is sometimes desirable to break the portion of the mounting bracket plate containing the mounting fastener apertures 34 away from the remainder of the plate, the plate may be provided with an elongated open slot 35 and lines of weakness 36 to permit the portion containing the apertures 34 to be readily broken away from the remainder of the plate.

Figure 1:
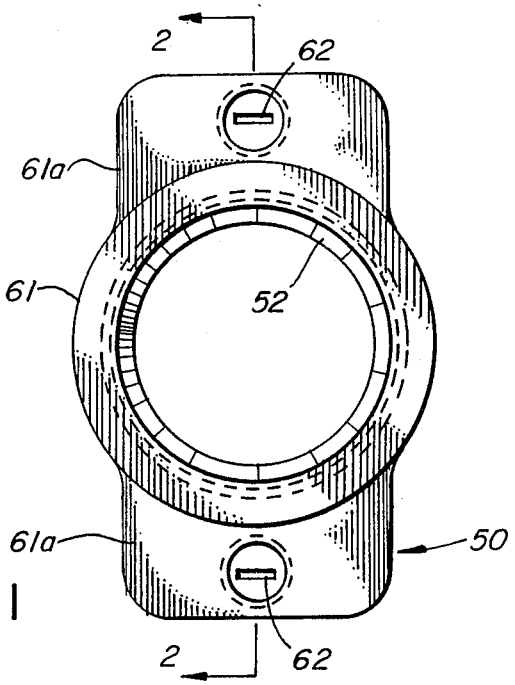
FIG. 1 is a front view of an adaptor in accordance with the invention.
Figure 2:
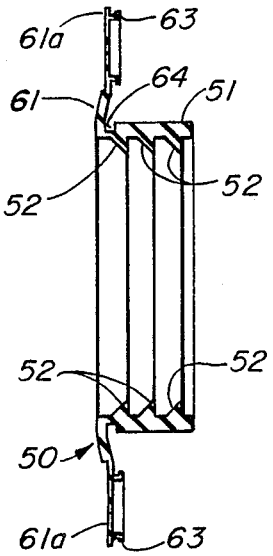
FIG. 2 is a cross-section of the adaptor of FIG. 1 taken along the line 2—2.

As best illustrated in FIGS. 1 and 2, the adaptor 50, which is formed of electrically insulated material consists of a deformable cylindrical or tubular portion 51 and a circular flange 61 projecting from an end thereof, with extensions 61*a* extending therefrom to overlie a portion of a surface of the mounting bracket plate. The inner surface of the cylindrical portion 51 is provided with a plurality (3 in the illustrated embodiment) of circumferential ribs 52, whereas the flange extensions 61*a* are provided with apertures 62 and rearwardly projecting circular beaded lips 63. The outer surface of the cylindrical portion 51 is slightly larger in diameter than the inlet aperture 31, and is provided, at the end adjacent to the flange, with a circumferential slot 64.

Figure 4:
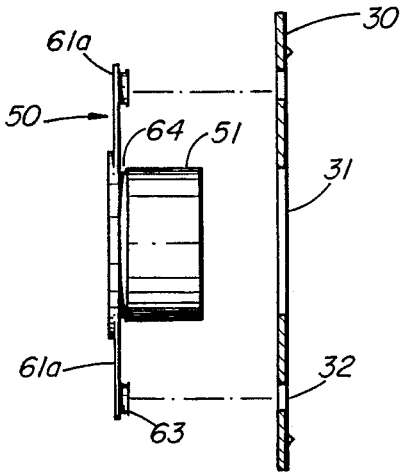
FIG. 4 is an exploded side view of the adaptor and mounting bracket plate of the invention.
Figure 5:
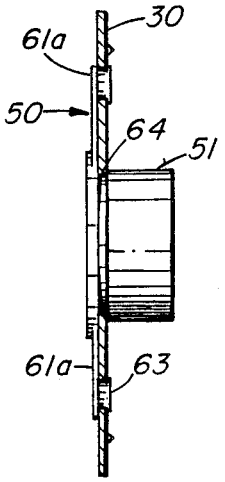
FIG. 5 is a side view of the adaptor assembled to the mounting bracket plate to form a mounting bracket assembly in accordance with the invention.

As best seen in FIGS. 4 and 5, the adaptor 50 is assembled to the mounting bracket plate 30 by inserting the deformable cylindrical portion 51 into the entrance aperture 31 of the mounting bracket plate until the edge of the entrance aperture 31 snaps into the slot 64 to retain the two elements in assembled relation, as illustrated in FIG. 5. The adaptor is so formed that the circular beaded lips 63 are, in assembled position, adjacent the electrical service apertures 32 in the mounting bracket plate, and the beaded lips are snapped into the apertures 32 to further secure the flange elements 61*a* in position adjacent a surface of the mounting bracket plate. Electrical wires such as those illustrated at 17 may then be passed through one or other of the apertures 62, depending upon which is most convenient for connection to the connector 16 on the face plate, and, in this way, the wires never come into direct contact with the metal edges or the metal surface of the mounting bracket plate service apertures 32. Indeed, even if the flange material surrounding the apertures 62 is torn to some extent, the beaded lips 63, which embrace the edges of the service apertures 32, will prevent direct contact between the electrical wires and the metal edges of the service apertures.

When the mounting bracket assembly, consisting of the adaptor 50 and the mounting bracket plate 30 are assembled as shown in FIG. 5, the assembly may be secured to a wall stud or the like, a tubular fitting, such as the 90° elbow 71 illustrated in FIG. 6 may be secured to the cylindrical portion 51 by gluing or the like, and the remainder of the tubular ducting, including straight sections such as 72 may be completed to connect the opening through the mounting bracket assembly to the central power unit (not shown) of the central vacuum system. The dry wall may then be applied to the outer surface of the wall studs, with an aperture cut away to expose the mounting bracket assembly, and the inlet valve may be applied by inserting the cylindrical projection 12 into the cylindrical portion of the adaptor, and connecting the face plate to the mounting bracket assembly by means of screws 33 or the like, as illustrated in FIG. 6.

The purpose of the circumferential ribs 52 on the inner surface of the cylindrical portion of the adaptor will now be apparent. They define an aperture slightly smaller in diameter than the outer surface of the cylindrical inlet valve projection 12 and thus tightly receive and embrace the cylindrical projection, and provide a seal between the outer surface of the cylindrical projection and the tubular ducting leading into the central vacuum power unit. In the illustrated embodiment, a triple seal is provided, by reason of the three circumferential ribs 52. It will be appreciated that the numbers of ribs may vary depending upon the quality of the seal desired.

The foregoing detailed description is for purposes of illustration only. It will be apparent that numerous variations and modifications may be effected by those skilled in the art without departing from the spirit and scope of the invention as defined in the appended claims.

What I claim as my invention is:

1. For use in a central vacuum cleaner inlet valve mounting bracket assembly comprising a mounting bracket plate having a circular inlet aperture, and at least one electrical service aperture therethrough:

a unitary adaptor of electrically insulating material comprising a deformable open-ended cylindrical connector of outside diameter slightly greater than said circular inlet aperture;

a flange projecting laterally from one end of said cylindrical connector and adapted to overlie a part of said mounting bracket plate, including said at least one service aperture; and an outer peripheral groove about said cylindrical connector, adjacent said flange and adapted to receive the edge of said mounting plate inlet aperture for snap attachment of said adaptor to said mounting bracket plate upon insertion of said cylindrical connector into said inlet aperture so that said flange abuts said mounting bracket plate.

2. The adaptor of claim 1, wherein said flange is provided with an aperture of lesser size than said electrical service aperture, said flange aperture being adapted to align with said electrical service aperture, when said adaptor is attached to said mounting bracket plate.

3. The adaptor of claim 2, including a beaded lip surrounding the flange aperture on the connector side of said flange, of corresponding configuration to the periphery of said service aperture, and adapted for snap engagement therewith.

4. An adaptor as defined in claims 1, 2 or 3, comprising a plurality of circumferential ribs projecting from the inner surface of said cylindrical connector.

5. The adaptor defined in claims 1, 2 or 3, comprising, three parallel, circumferential deformable ribs projecting from the inner surface of said cylindrical connector, said ribs being of triangular cross-section with a leading side sloping away from said flange and a trailing side substantially parallel with said flange.

6. A central vacuum cleaner inlet valve mounting bracket assembly comprising a mounting bracket plate having a circular inlet aperture and at least one electrical service aperture therethrough; and a unitary adaptor of electrically insulating material comprising a deformable open-ended cylindrical connector of outside diameter slightly greater than said circular inlet aperture, a flange projecting laterally from one end of said cylindrical connector and overlying a part of said mounting bracket plate, including said at least one electrical service aperture, and an outer peripheral groove about said cylindrical connector, adjacent said flange, the edge of said mounting plate inlet aperture being removably seated in said peripheral groove for connection of said adaptor to said plate.

7. The assembly of claim 6, wherein said flange is provided with an aperture of lesser size than said electrical service aperture, and in alignment therewith.

8. The assembly of claim 7, wherein said flange comprises a beaded lip surrounding said flange aperture on the connector side of said flange and in connecting engagement with the peripheral edge of said electrical service aperture.

9. The assembly of claim 6, wherein said mounting bracket plate comprises two circular electrical service apertures symmetrically disposed above and below said inlet aperture and on a diametric axis thereof.

10. The assembly of claim 9, wherein said mounting bracket plate is provided with a pair of mounting apertures adjacent a lateral edge thereof, a pair attachment apertures above and below said electrical service apertures for attachment of a cover plate thereto, and a line of weakness separating that portion of the plate carrying the mounting apertures from the remainder of the plate.

11. The assembly of claim 10, wherein said flange comprises a pair of apertures in alignment with said electrical service apertures, and a pair of beaded circular lips projecting from the connector side of said flange and in connecting engagement with the peripheral edge of an aligned electrical service aperture.

12. The assembly of claims 6, 8 or 11, comprising a plurality of circumferential ribs projecting from the inner surface of said cylindrical connector.

13. The assembly of claims 6, 8 or 11 comprising, three parallel circumferential, deformable ribs projecting from the inner surface of said cylindrical connector, said ribs being of triangular cross section with a leading side sloping away from said flange, and a trailing side substantially parallel with said flange.

* * * * *